United States Patent [19]

Jackman

[11] Patent Number: 5,025,120

[45] Date of Patent: Jun. 18, 1991

[54] INSERT FOR A HYDRO POLE SWITCH

[76] Inventor: William E. Jackman, P.O. Box 493, 24 Stewart Drive, Lakefield, Ontario, Canada, K0L 2H0

[21] Appl. No.: 293,937

[22] Filed: Jan. 6, 1989

[30] Foreign Application Priority Data

Jan. 8, 1988 [CA] Canada ..... 556080

[51] Int. Cl.[5] ..... H01H 33/00; H01B 17/00

[52] U.S. Cl. ..... 200/49; 174/138 D

[58] Field of Search ..... 200/48 R, 49; 174/138 D, 138 R, 177, 46, 5 R, 55 G, 55 B; 285/47, 48; 403/336, 337, 335, 338

[56] References Cited

U.S. PATENT DOCUMENTS

| | | | |
|---|---|---|---|
| 777,215 | 12/1904 | Meston | 174/138 D |
| 1,045,679 | 11/1912 | Cronin | 174/138 D |
| 1,163,967 | 12/1915 | Arntzen | 403/336 |
| 1,864,351 | 6/1932 | Hendee | 174/138 |
| 1,994,938 | 3/1935 | Bott | 174/138 D |
| 2,738,210 | 3/1956 | Hjembo | 403/335 |
| 3,328,058 | 6/1967 | Gundlach | 403/326 |
| 3,637,959 | 1/1972 | Bridges | 200/48 R |
| 3,647,996 | 3/1972 | Bernatt et al. | 200/48 R |

FOREIGN PATENT DOCUMENTS

| | | | |
|---|---|---|---|
| 792338 | 8/1968 | Canada . | |
| 908706 | 8/1972 | Canada . | |
| 1087234 | 10/1980 | Canada . | |
| 1090400 | 11/1980 | Canada . | |
| 491686 | 1/1930 | Fed. Rep. of Germany | 174/46 |

*Primary Examiner*—Henry J. Recla
*Assistant Examiner*—Glenn T. Barrett

[57] ABSTRACT

An insert for a hydro pole switch is disclosed. The insert has a rod member extending the length of a hydro pole and terminating at a handle. The rod member is formed from spaced inline rod portions with adjacent end portions separated by a predetermined spacing. The insert has an element formed from electrically insulating material having a first flange mounted on each end thereof; a pair of coupling members are provided for engagement with the first flanges and each are attachable with a corresponding end portion, whereby the insert enables the handle to be electrically isolated from its associated switchgear in a simple and economic manner.

6 Claims, 2 Drawing Sheets

INSERT FOR A HYDRO POLE SWITCH

Figure 1:
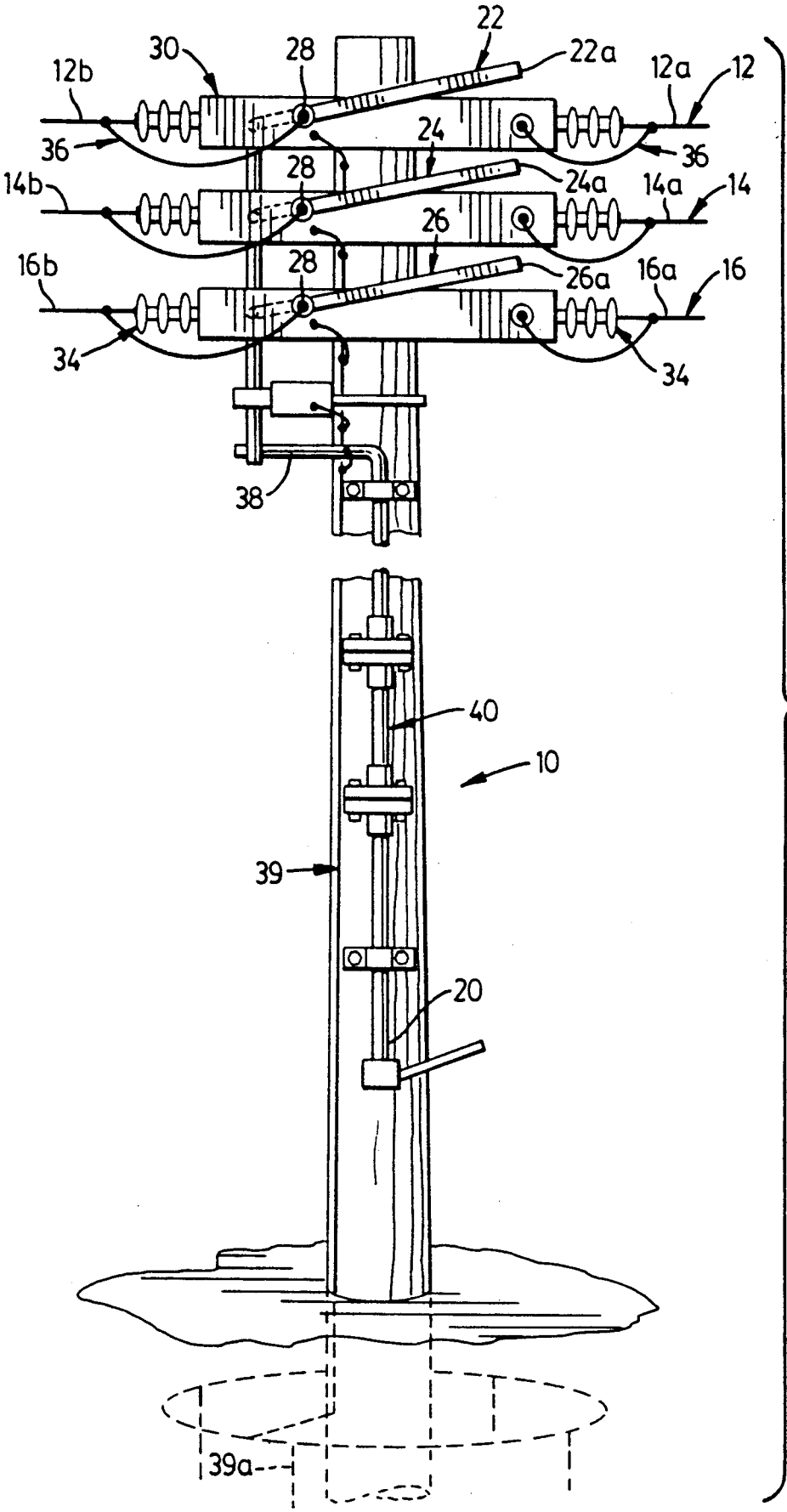

The present invention relates to high voltage transmission.

It is well known that power lines are suspended from the ground on a network of hydro poles. The poles are each provided with a number of insulators which serve to anchor the line to the pole while insulating the pole therefrom. At various locations along a powerline, switches are provided to enable making and breaking of parallel on circuits or to enable isolation of sections of the circuit.

Due to its metal construction, the conventional Air Break Switch becomes energized should any of the insulators fail. This means that a surge current to ground will occur from the Switch through to the ground grid network. This surge is sensed by a series of circuit protection relays which, if operating properly, interrupt the circuit.

The switch is moveable between "closed" and "open" positions as are dictated by the orientation of a blade relative to a pair of spaced contacts. The switch is typically manual and operated by means of a handle at ground level joined to the blade operating mechanism by a metal pipe. The handle is readily accessible and operable simply by releasing a lock hold the switch in either the "open" or "closed" position.

These switches known in the field as Air Break Switches are of a metal construction and are joined along with other supporting hardware to a copper cable extending along the pole to a number of ground rods in the ground adjacent to the pole.

However, it is common for the ground grid network to be faulty, and because all the rods and connections are underground, it is difficult and time consuming to inspect.

As well, protection and control relays have been known not to respond immediately to the power surge, thereby rendering the pipe and handle energized for a considerable amount of time, causing a serious danger to the switch operator and/or the general public.

It is therefore an object of the present inventor to provide a novel form of switch.

Briefly stated, the invention involves an insert for a hydro pole switch having a rod member extending the length of a hydro pole and terminating at a handle, said rod member being formed from spaced inline rod portions with adjacent end portions separated by a predetermined spacing, said insert comprising;

an element formed from electrically insulated material having a first flange mounted on each end thereof, a pair of coupling members for engagement with said first flanges and each attachable with a corresponding end portion, whereby said insert enables said handle to be electrically isolated from its associated switchgear in a simple and economic manner.

In another aspect of the present invention, there is provided a kit for electrically isolating the handle of a hydro pole switch of the type having a switch assembly joined to the handle by a rod member having a pair of inline rod portions spaced from one another by a predetermined distance and extending the length of the pole, said kit comprising a member formed from electrically nonconductive material having a pair of ends defined by a corresponding pair of first mounting flanges, a pair of coupling elements for attachment with adjacent end portions of said spaced rod portions, each of said coupling elements having a second mounting flange arranged to engage one of the first mounting flanges, whereby said insert can be inserted at any desired location along said rod member without requiring said switch assembly to be disassembled.

In yet another aspect of the present invention, there is provided a method of electrically isolating the handle of a hydro pole switch from its associated switchgear, said hydro pole switch having a rod member extending along the length of the hydro pole and joining the handle with said switchgear, said method comprising the steps of:

manipulating said rod member into a pair of inline rod portions with a corresponding pair of ends separated by a predetermined spacing, providing a member formed from an electrically nonconductive material with a pair of ends each of which is defined by a first mounting flange, providing a pair of coupling members for attachment to said adjacent ends, forming a second coupling flange on each of said coupling members for engagement with one of said first mounting flanges, attaching said second coupling members with said adjacent end portions and engaging each of said first flanges with a corresponding second flange, and attaching said engaged first and second mounting flanges together.

In still another aspect of the present invention there is provided a switch for use on a hydro pole supporting a number of insulators attached to a corresponding number of hydro lines comprising:

a switchgear to control power flowing through said line at said insulator, including a number of actuating levers moveable between "open" and "closed" positions, said levers joined to an actuating mechanism to displace said levers in unison, a rod member mounted on and extending along the length of said pole and joined at one end with said actuating mechanism, a handle joined to the opposite end of the rod member for rotating said rod member thereby to operate said mechanism, at least a portion of said rod member being formed from an electrically nonconductive material for electrically isolating said handle from said mechanism.

A preferred embodiment of the present inventor will now be described by way of example only as illustrated in the appended drawings in which FIG. 1 is a perspective view of a hydro assembly on a power line.

Figure 2:
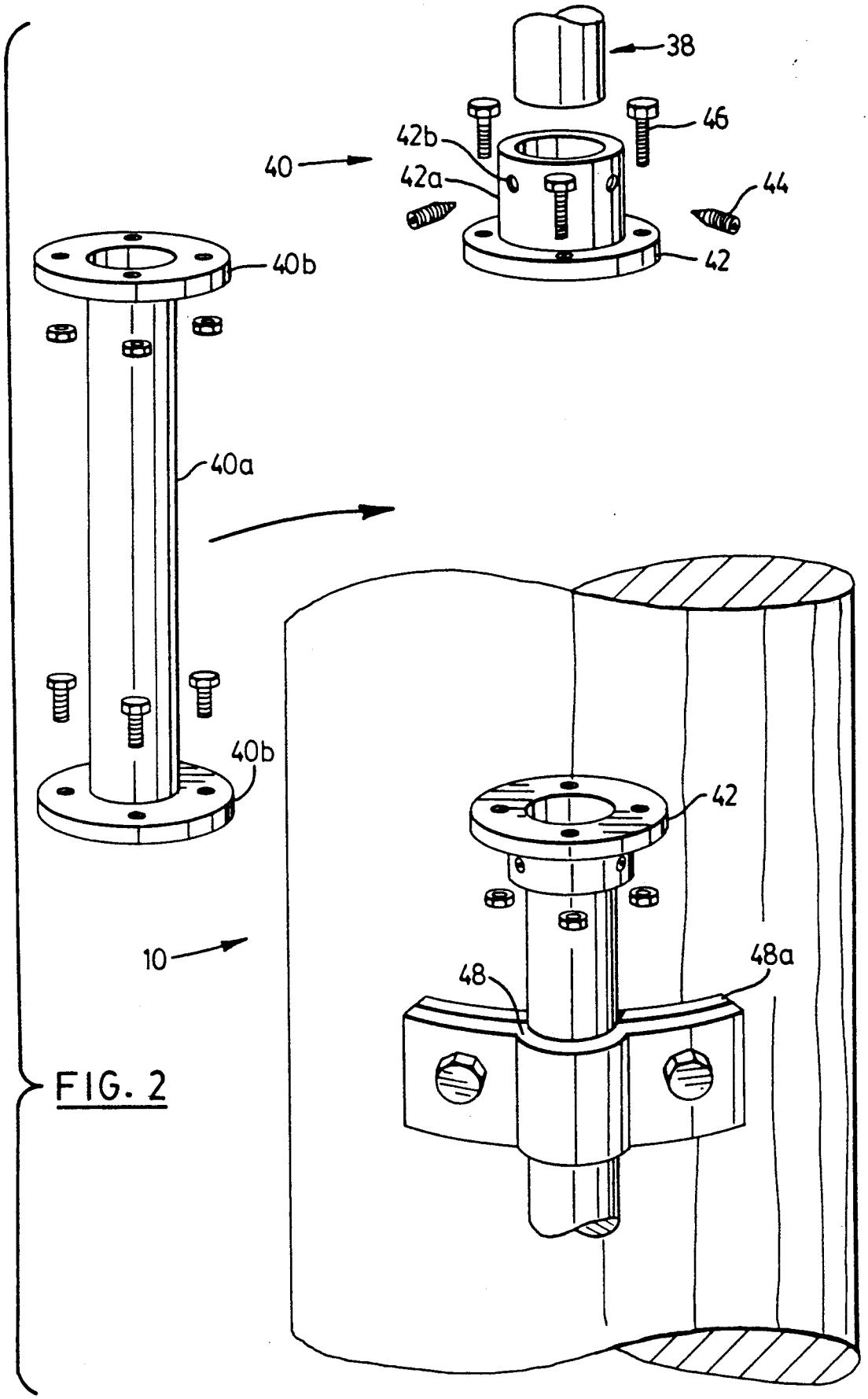

FIG. 2 is a magnified fragmentory possibly exploded view of an element of the assembly illustrated in FIG. 1.

Referring to the drawings there is provided a hydro pole 10 supporting three conductors 12, 14 16. Each conductor is separated by an insulated switch mechanism 18 including an operating handle 20. As will be described. the handle is electrically insulated from switch mechanism.

The switch mechanism (18) has three blades 22, 24 26 each for a respective one of conductors, 12, 14, 16. The blades are mounted on an insulated base 28 pivoted to a support member 30. The free end of the blades shown as 22*a*, 24*a*, 26*a* are each aligned for contact with an insulated contact 32 which is also mounted on the support member 30. The support member also supports a number of dead end insulators 34 which, in turn, anchor on end of a conductor to the pole.

A live line loop shown at 36 joins the conductor end to the contacts 32 and 28.

Each of the blades is coupled to a vertical arm 38 which extends downwardly along the pole.

In the midsection of the arm 38 is an insulator assembly 40 shown in FIG. 1 and FIG. 2. The insulator assembly 40 has a body 40*a* formed from a non-conductive material such as fibreglass. Joined at each end of the body 40*a* are a pair of flanged members 40*b*, each of which has a number of spaced bores. The flanged members 40*b* have an outer surface which is dimensioned to engage complimentary surfaces on flanged members 42 on upper and lower sections of the arm 38.

The flanged members 42 have a collar portion 42*a* with a number of radially oriented threaded bores 42*b*, which receive a piercing stud 44. Flange 40*b* is joined to flange 42 by means of fasteners 46.

The arm 38 is rotationally coupled to the pole 10 by way of brackets 48. The brackets 48 are formed from fibreglass materials and include a base 48*a* both of which insulate the arm 38 and handle 20 from the pole with a strength to transmit actuating forces delivered at the handle 20 the actuating assembly.

While the insulator assembly is shown in FIG. 1 above several of the brackets 48, a particular feature of the insulator assembly is that it may be located at any desired location along the rod member and hence the pole depending on the circumstances.

In summary, if there was insulator breakdown on this switch, any steel 38 above the insulator 40 would still be grounded to the grid network, the arm 38 below the insulator 40 would not be tied into the ground grid and would be insulated from the pole 10 and the switch and wires above, thereby making a safe area for operators of the switch and the general public.

What is claimed is:

1. An insert for a hydro pole switch of the type having a shaft extending the length of a hydro pole and having an upper end and a lower end, a handle joined to said lower end and a switch gear joined to said upper end and responsive to rotation of said shaft to actuate said switch gear, said shaft being formed from a pair of spaced inline shaft rod portions with adjacent end portions separated by a predetermined spacing, said insert comprising:

a rod formed of electrically insulating material having a pair of ends; said rod having a length sufficient to be positioned in line between said end portions; said rod having a radially extending first flange mounted on each end thereof;

a pair of coupling members to join said first flanges with said end portions; each of said coupling members including a second radially extending flange and attachment means to join said coupling member to said end portion; each of said coupling members being arranged to engage said first flanges when said rod is inserted in the space between said second flanges following the attachment of said coupling members to said adjacent end portions.

2. An insert as defined in claim 1 wherein said rod has a longitudinal axis, each of said first and second flanges has a surface which lies perpendicular to said longitudinal axis; said first and second flanges being arranged to slide against one another along said surfaces when said rod is inserted between said coupling members.

3. An insert as defined in claim 1 wherein said first and second flanges include a plurality of inline holes spaced along the periphery thereof to receive fasteners to fix said first flange to said second flange.

4. An inset as defined in claim 1 wherein said attachment means includes a first collar means having a passage formed therein to receive said end portion.

5. A kit for electrically isolating a handle of a hydro pole switch of the type having a switch assembly joined to the handle by a shaft having a pair of inline shaft portions spaced from one another by a predetermined distance and extending the length of a hydro pole, said kit comprising:

an elongate rod member formed from electrically nonconductive material having a pair of ends defined by a corresponding pair of first radially extending flanges, a pair of coupling members for attachment with adjacent end portions of said spaced shaft portions, each of said coupling members having a second radially extending flange arranged to engage one of said first mounting flanges, whereby said insert can be inserted at any desired location along said shaft without requiring said switch assembly to be disassembled from said hydro pole.

6. A method of electrically isolating a handle of a hydro pole switch from its associated switch gear, said hydro pole switch having a shaft extending along the length of a hydro pole and joining the handle with said switch, gear, said method comprising the steps of:

severing said shaft into a pair of inline shaft portions with a corresponding pair of adjacent ends separated by a predetermined spacing:

providing a member formed from an electrically nonconductive material with a pair of ends, each of which is defined by a first mounting flange, providing a pair of coupling members for attachment to said adjacent ends, forming a second coupling flange on each of said coupling members for engagement with one of said first mounting flanges, attaching said second coupling members with said adjacent end portions and engaging each of said first flanges with a corresponding second flange; and attaching said engaged first and second mounting flanges together.

* * * * *